US008690154B2

(12) United States Patent
Owoc

(10) Patent No.: US 8,690,154 B2
(45) Date of Patent: Apr. 8, 2014

(54) SAFE AND NOVEL, LIGHTWEIGHT HAND-GRIP SYSTEMS FOR MANUALLY SPINNING GAMING WHEELS

(76) Inventor: Greg John Owoc, Greenville, SC (US)

( * ) Notice: Subject to any disclaimer, the term of this patent is extended or adjusted under 35 U.S.C. 154(b) by 602 days.

(21) Appl. No.: 12/493,170

(22) Filed: Jun. 27, 2009

(65) Prior Publication Data

US 2010/0327523 A1 Dec. 30, 2010

(51) Int. Cl.
*A63B 71/00* (2006.01)

(52) U.S. Cl.
USPC ..... 273/142 R

(58) Field of Classification Search
None
See application file for complete search history.

(56) References Cited

U.S. PATENT DOCUMENTS

| | | | | |
|---|---|---|---|---|
| 270,362 | A | 1/1883 | Alpress | |
| 614,418 | A | 11/1898 | Blount | |
| 1,812,946 | A * | 7/1931 | Grubb | 472/14 |
| 1,990,859 | A | 2/1935 | Elliott | |
| 2,003,979 | A | 6/1935 | Skoric | |
| D99,024 | S * | 3/1936 | Hines | D21/374 |
| 2,077,124 | A | 7/1936 | Miller et al. | |
| 2,573,475 | A | 10/1951 | McFarland | |
| 2,881,638 | A * | 4/1959 | Taylor | 74/552 |
| 3,941,389 | A | 3/1976 | Guimond | |
| 4,210,331 | A | 7/1980 | Kulesza et al. | |
| 4,492,378 | A | 1/1985 | Williams | |
| 4,687,218 | A * | 8/1987 | Okamoto | 280/250.1 |
| 4,813,676 | A | 3/1989 | Weatherspoon | |
| 4,834,385 | A | 5/1989 | Jackson | |
| 5,164,821 | A | 11/1992 | Tanaka et al. | |
| 5,188,363 | A * | 2/1993 | Marnell et al. | 463/13 |
| 5,320,372 | A * | 6/1994 | Langen | 280/207 |
| 5,340,214 | A | 8/1994 | Juzwiak | |
| 5,476,019 | A | 12/1995 | Cheever et al. | |
| 5,788,573 | A * | 8/1998 | Baerlocher et al. | 463/16 |
| 5,947,820 | A * | 9/1999 | Morro et al. | 463/9 |
| 5,989,123 | A * | 11/1999 | Tosaki et al. | 463/37 |
| 6,276,705 | B1 * | 8/2001 | Baldwin et al. | 280/250.1 |
| 6,322,074 | B1 * | 11/2001 | Forrest et al. | 273/272 |
| 6,389,929 | B1 | 5/2002 | Calilung et al. | |
| 6,530,864 | B1 * | 3/2003 | Parks | 482/4 |
| 6,880,855 | B2 | 4/2005 | Chernoff et al. | |

(Continued)

FOREIGN PATENT DOCUMENTS

JP 2005007942 A 1/2005

OTHER PUBLICATIONS

United States Patent and Trademark Office; Office Action; Office Action from U.S. Appl. No. 12/931,666; copyright and mailing date Sep. 27, 2012, pp. 1-9, publisher United States Patent and Trademark Office, Alexandria, Virginia, USA; (9 pages).

*Primary Examiner* — Kurt Fernstrom
*Assistant Examiner* — Dolores Collins
(74) *Attorney, Agent, or Firm* — Neal P Pierotti; Mintz Lewis Brodman Must O'Keefe LLC

(57) ABSTRACT

A hand grip system is provided for manually gripping and spinning gaming wheels or rotatable gaming apparatus. A rotatable gaming wheel with a plurality of annularly arrayed stop position means may be affixed near an outer board diameter of the wheel. At least one sector identification member may be used to randomly select a sector of a game board base of the wheel. An annular graspable member may be located above at least one of the annularly arrayed stop position means so as not to inhibit function of the sector identification member as the rotatable gaming wheel is spun.

20 Claims, 10 Drawing Sheets

(56) References Cited

U.S. PATENT DOCUMENTS

| | | | | |
|---|---|---|---|---|
| 7,100,916 | B2 * | 9/2006 | Kelly et al. | 273/138.1 |
| 7,563,097 | B2 | 7/2009 | Lavigna et al. | |
| 7,578,745 | B2 * | 8/2009 | Wingerstahn | 472/18 |
| 7,766,329 | B1 * | 8/2010 | Kelly et al. | 273/138.1 |
| 7,775,870 | B2 * | 8/2010 | Kelly et al. | 463/16 |
| 7,824,252 | B1 * | 11/2010 | Kelly et al. | 463/7 |
| 7,832,727 | B1 * | 11/2010 | Kelly et al. | 273/138.1 |
| D631,930 | S * | 2/2011 | Krauss et al. | D21/830 |
| 7,878,506 | B1 * | 2/2011 | Kelly et al. | 273/138.1 |
| 2002/0149257 | A1 | 10/2002 | Miansian et al. | |
| 2005/0167912 | A1 | 8/2005 | Sokolov | |
| 2005/0243468 | A1 | 11/2005 | Miyamoto | |
| 2006/0038343 | A1 | 2/2006 | Adams | |
| 2006/0119036 | A1 | 6/2006 | Scozio | |
| 2008/0203702 | A1 * | 8/2008 | Noye | 280/304.1 |
| 2009/0139424 | A1 | 6/2009 | Norman et al. | |
| 2010/0327523 | A1 | 12/2010 | Owoc | |
| 2012/0200033 | A1 | 8/2012 | Owoc | |

* cited by examiner

PRIOR ART (TOP VIEW)

(SIDE VIEW)

(TOP VIEW)

(SIDE VIEW)

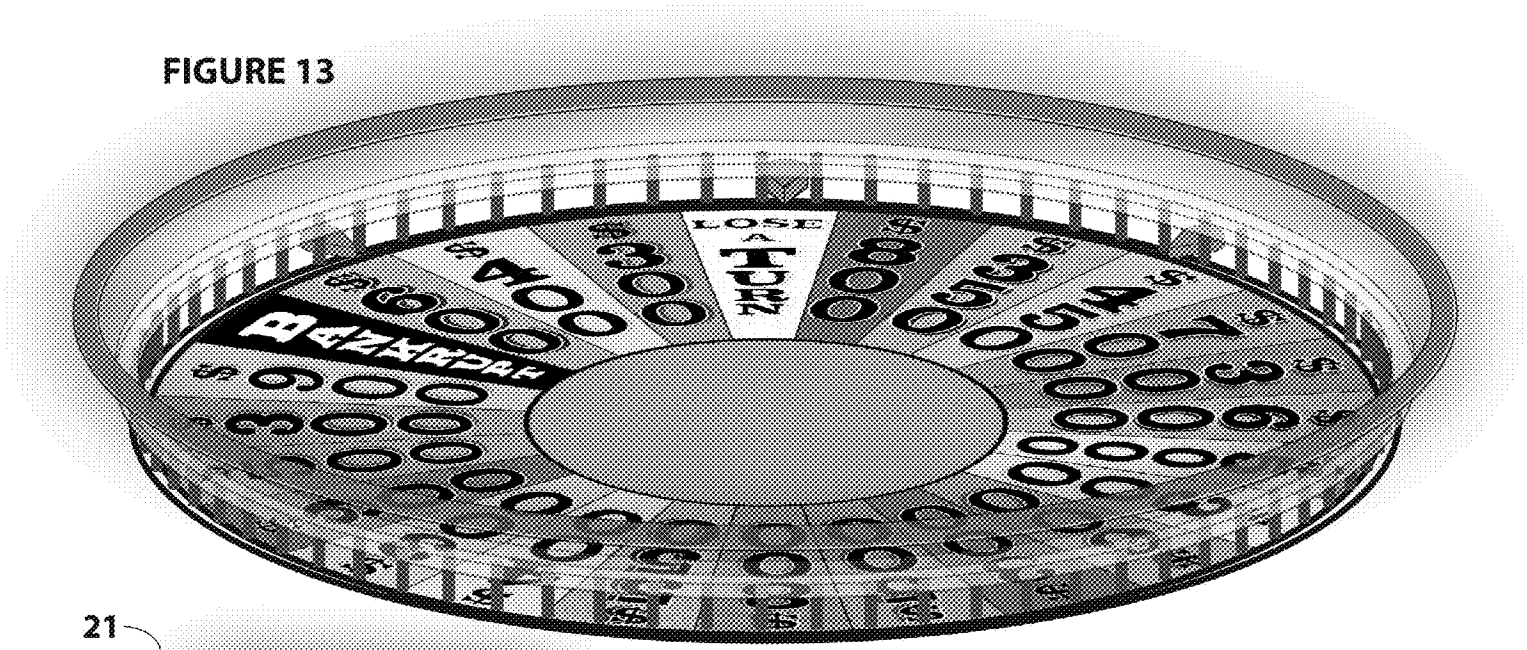
Hz
Hz
Hz

FIGURE 19
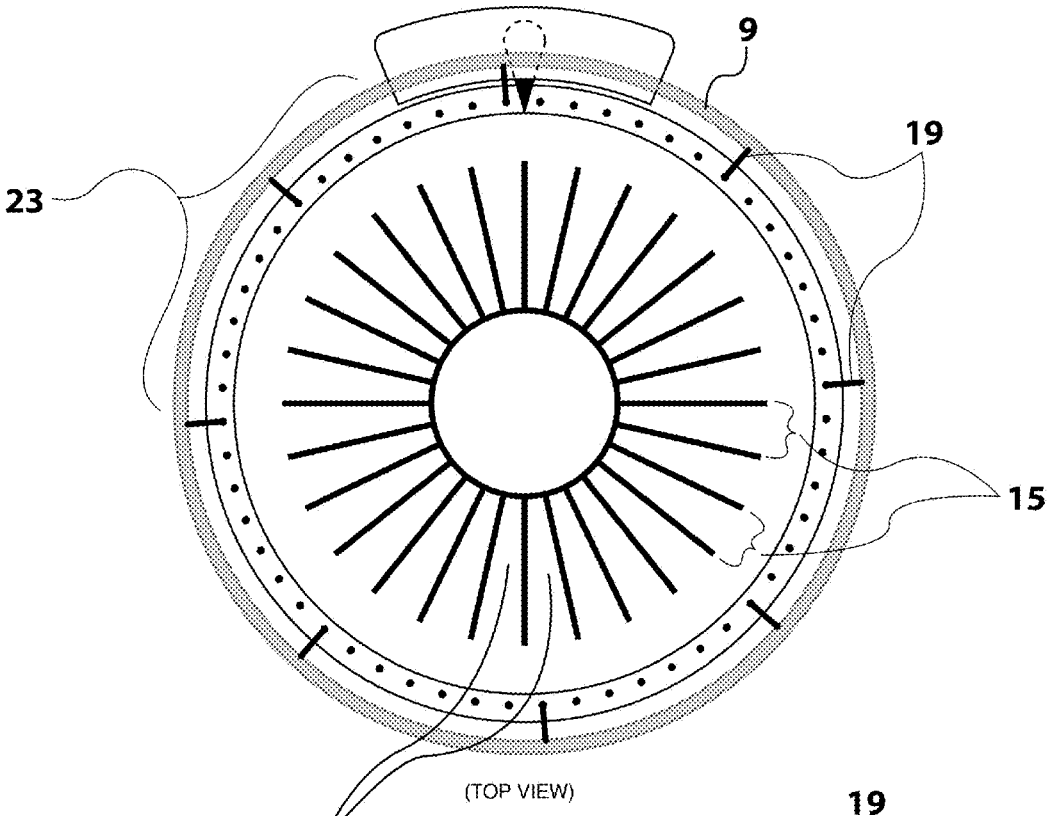
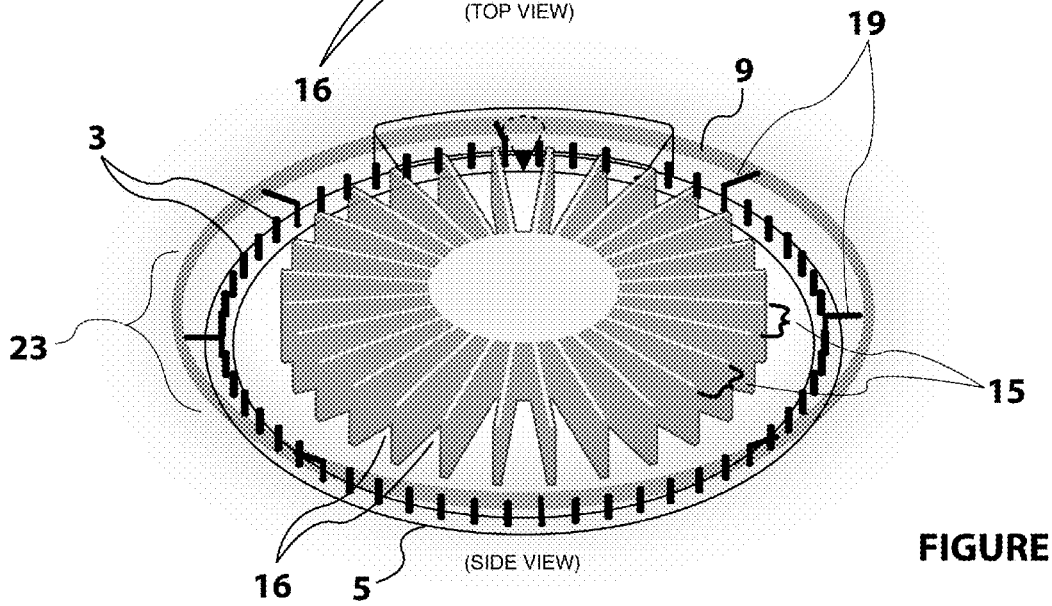
FIGURE 20

SAFE AND NOVEL, LIGHTWEIGHT HAND-GRIP SYSTEMS FOR MANUALLY SPINNING GAMING WHEELS

BACKGROUND OF THE INVENTION

1. Field of the Invention

This invention relates generally to gaming wheels or rotatable gaming apparatus which may be manually spun by a user's hand to select, by chance or by skill, various numbers, colors or other informational fields or sectors on a rotating game board or wheel. More specifically, the field of the present invention is narrowed to gripping means that may be employed to prevent risk of injury primarily to a user's hand, and enhance convenience when actuating or rotating such wheels, aka., Wheel of Fortune®," "Games of Chance Wheels," Wheels of Chance, or "Prize Wheels."

2. Description of Prior Art

The art of record discloses minimal innovations as to hand grip systems or gripping apparatus that increase safety and simplify the game wheel user's experience. The standard methods or structures that the majority of former art uses is simply to "grab the edge of the rotatable board or wheel" and spin it, whether the spinning axis is perpendicular or parallel to the ground. These wheels use a rotating board that typically comprises an annularly arrayed set of pegs or raised surfaces, most often affixed to their outer peripheries, which rotate with the wheel and strike a spring-clicking flipper indicator(or multiple flipper indicators, aka. sector identification members) that determines the stop point and informational field or sector which is "played" by the game wheel user. Various wheels whose axis is parallel to the ground are found in U.S. Pat. Nos. 614,418; 2,077,124; 5,164, 821; 5,340,214 and others. These are typically activated by simply grasping the side of the wheel by hand then thrusting downward to effect rotation. Other patents or former art disclose use a crank handle to turn the wheel or apparatus, usually for mixing up chance pieces, as bingo balls, are found in U.S. Pat. Nos. 2,003,979; 4,813,676; and 4,834,385. Several chance wheels whose axis is perpendicular to the ground are described in U.S. Pat. Nos. 1,990,859, 4,210,331 and U.S. Design Pat. No. 270,362.

The disadvantages posed to a user of these wheels are many. First, typically grasping these "pins" and spinning the wheel, some wheels which are large and weighty and requiring significant torque force, can greatly risk injury to a user. The problem having to grasp these pins presents is that a user's hand or fingers could get caught in between the pins as the wheel is thrust around and released. As well, the pins have a fairly pointed terminus jutting upwardly from the game board surface, and though typically rounded, still this could scratch or potentially puncture the hand, and injure a user. This is true whether the wheel axis spin is perpendicular or parallel to the ground. This structural deficiency creates a liability hazard to those businesses who employ these types of wheels in their show or business venues. In fact, there has doubtless been several injuries sustained by users of these wheels over the decades of use in various venues, the inventor being aware of one of recent occurrence on the Wheel of Fortune Game Show televised EST 7 pm May 22, 2009.

Secondly, spinning a wheel with such limited area or portion to hold onto, by grasping and slinging forward such a small and thin, long pin, as those that are used in the popular game show, Wheel of Fortune, simply adds to the difficulty and distress of playing an otherwise exciting and rewarding game.

Thirdly, having to bend down and stress the back, in addition to the above dangers of the pins creates even more risk of injury to a user. Moreover, a shorter-bodied person would not thus be excluded form eligibility based on their size and slight physical limitation to spin or operate such a wheel as on Wheel of Fortune Game Show.

Another disadvantage is that the long length of the pins can tend to obstruct the view of the rotating board both from the contestant and the audience's scope of view.

Another disadvantage of the present art is that the pins, aka., as annularly arrayed stop position means, could conceivably be bent by a robust wheel user or contestant.

As well, the pins need to be protected additionally in shipping the entire game board apparatus, as the wheels are sent to various show locations and venues, and the support ring of the present invention readily provides this added pin protection benefit by conveniently enclosing the tips of the pins within the ring's structure.

Picking up removable cards within the inner radius of the board, as potentially "nested" within certain said sectors and having to physically "clear" the pins to do so presents a danger to a contestant, as in Wheel of Fortune Game Show. Again, but a shorter-bodied person would not thus be excluded form eligibility based on their size and slight physical limitation to spin or operate such a wheel of the present invention.

Yet another disadvantage is that there is no foolproof way of conveniently electrically signaling the contestant, as in the Wheel of Fortune Game, to know when to spin the wheel, as the Show host must continually verbally cue the contestant to spin the wheel the present invention solves this deficiency, as well.

Lastly, another disadvantage to the Wheel Game owners is that the contestant cannot spin the wheel for a complete revolution very easily and thus can possibly "steal" a sector that is favorable by only moving the wheel for a small controlled "non-chance" distance. A means is needed to spin the wheel which would make it both easy and a requirement for any level of strength contestants to spin the wheel close to or for at least a full revolution, while still not at all burdening any wheel user. This would add to the uncertainty of the outcome and eliminate any "cheating" by a contestant, and provide more overall excitement and suspense for both the contestants and audience the watching the game.

The former art that the present invention focuses upon and improves is found in the structure of wheels that use, as mentioned above, a rotating board that typically comprises an annularly arrayed set of pegs, in which are inherent these above discussed disadvantages. More of these systems are disclosed on the website of www.wheels-of-chance.com and the type of wheels (both the large main wheel and the smaller final "winners" spin wheel) that are used on the Game Show "Wheel of Fortune®." It is particularly these latter Chance Wheels that the present invention seeks to significantly improve, as further discussed in the following Summary.

SUMMARY OF THE PRESENT INVENTION

In view of the formerly discussed disadvantages inherent in the presently known Gaming Wheels, particularly those of the Wheel of Fortune Game Show type, it is an object of the present invention to provide a hand grip system for gaming wheels that provides major improvements to upgrade the former art in the categories of safety, ease of use, elimination or minimization of visual or hand obstruction, minimization of stress, and bodily over-stretching, (particularly for shorter, smaller arm people, upon user when spinning the wheel), minimizing of contestant cheating and finally, convenient electronic signaling of the contestant, and thus would provide overall enhanced pleasure of the game.

To attain the above improvements the invention discloses novel, lightweight hand grip systems for safely manually grasping, gripping and spinning the gaming wheels above described. One of many key objectives of the above structures is to keep the wheel user's hands completely away from touching any pins, and thus take away all the risk of the user's hand, finger or body being injured by the pins.

Since in all four embodiments of the invention the pins tips are covered, and the user is grasping the wheel instead of the pins, the objective of safety from being injured by these pins may be achieved for the user.

There is also another safety factor objective, in that if a shorter (or any size contestant for that matter) contestant were to overstretch themselves and accidentally flip over the separating barrier (as in stretching over the short wall to pick up a card on the board, as if often the case in Wheel of Fortune), and fall onto the pins, this could result in a disastrous injury. However, this potential problem is nearly totally prevented with the present invention, since in all three embodiments the pin tips are either over molded by the annular member or shrouded by it, and the annular grasping member, or circular spin-rail is at a height that is easily reachable and graspable by a user.

The objective of ease of use over old art may be achieved also, since the wheel is much easier to hold onto and pull sideways by even someone with shorter and/or less powerful arms, since leverage is greatly increased with the present invention.

Because of the convenient position and ease of use of the lightweight annular graspable member, the back of a user, as one in as a Wheel of Fortune Contestant, does not have to bend over quite so much, thus greatly reducing back injury, thus another objective of safety over prior art.

Since in all of the embodiments, the pins' length, of for instance, the Wheel of Fortune type wheel, are reduced by up to 60% or more, weight reduction for the entire spinning board system may be reduced, even accounting for the added weight of the entire hand grip system, thus keeping to the objective of a light total gaming wheel apparatus.

Since the long length of the pins are greatly reduced in all of the preferred embodiments, visual obstruction by the contestant as they look at the board, as well as the audience viewers is nearly eliminated, as well.

The annular member may also comprise electrical or electronic signaling means within its structure to signal a user when their turn to spin comes, and as well to add to the exciting lighting effects on any show venue using such wheels. The Game Show moderator may signal the contestant visually, rather than verbally to spin the wheel through a remote radio signal to the board, or the signal may be hard wired to the board's said annular member or annular rail. This annular graspable member may have a light source inside that may emit through a generally clear or colored translucent material, as a clear polymer, such as polycarbonate or acrylic or any other variety or combination of polymer, metal, wood or even carbon fiber materials.

Four main variations in the subject hand grip system invention that may achieve the above objectives above are comprised in three preferred embodiments of the said hand grip system, each of which includes an annular member that may be rigidly suspended above, upon, or within the circumference of the gaming apparatus or wheel. The annular graspable member is preferably attached to spacer pins (or any uniform random "stop" positions means annularly arrayed upon the board, usually engaged by at least one, but potentially multiple spring-clicking flipper-indicators that define sectors), and thus does not impede the function of the flipper-indicator (sector identifier member or members).

The first embodiment includes a hand grip system as having a preferably clear polymer annular support-ring that is affixed annularly to the top of the "old art" pins of the former art. These pins would remain in the same general location, connected to the game board base, as in the old art, in a similar annularly arrayed position, but would be shorter in length, yet so that the said flipper indicator's (aka., sector identification member) thickness could easily pass under this said support ring, even as the game wheel was spun. Jutting outward, inward or upward from the said support ring are annular graspable member stanchions, or support arms that both connect and support an annular graspable member, what also may be known as a circular rail. The user simply grasps this annular graspable member with their hand and manually thrusts it in one direction, rather than grasping the old art pins, and risking injury to their hands, at the very least. It is to be noted that in assembly the pins would not have to be fixedly sealed into the support ring or the annular grasping member, but cold be "slip fit" so that easily assembly and disassembly of the entire gaming board apparatus could occur.

The second embodiment includes a hand grip as having preferably a clear polymer annular support-ring that is affixed annularly to the top of the "old art" pins of the former art. These pins would remain in the same general location, connected to the game board base, as in the old art, in a similar annularly arrayed position, but would be shorter in length, yet so that the said flipper indicator's thickness could easily pass under this said support ring, even as the game wheel was spun. Jutting outward, inward or upward from the said support ring is an annular flange rim integrally joined, preferably molded or formed as one piece, to an annular graspable member, or what also may be known as a circular rail. The user simply grasps this annular graspable member with their hand and manually thrusts it in one direction, rather than grasping the old art pins, and risking injury to their hands, at the very least. This second embodiment is considered to be more foolproof and safer than the first or third embodiments, since there are no connecting members the user cannot get their fingers or hand caught on anything, as on a said pin or on an upwardly jutting support arm, aka., annular graspable member support means. It is to be noted that in assembly the pins would not have to be fixedly sealed into the support ring or the annular grasping member, but cold be "slip fit" so that easy assembly and disassembly could occur.

The third embodiment includes a hand grip system as having preferably a clear polymer annular graspable member, or what may be known as a circular rail that is affixed annularly to the top of at a few of the "old art" pins of the former art. Most of these pins would remain in the same general location, connected to the same board base, as in the old art, in a similar annularly arrayed position, but would be shorter in length, yet so that the said flipper indicator's thickness could easily pass under this said support ring, even as the game wheel was spun. However, several of the pins, at least three, but preferably at least eight would be longer than the other remaining annularly arrayed pins. These few key support pins would be jutting outward, inward or upward from the said board in the same annular array of pins, and these several support pins, preferably equally spaced around the board circumference, would attach at their upper, opposite ends (toward the game board side) into the annular graspable member, or what also may be known as a circular rail. The user simply grasps this annular graspable member with their hand and manually thrusts it in one direction, rather than grasping the old art pins, and risking injury to their hands, at the very least. This third embodiment may be understood as the easiest embodiment to manufacture and employ for the stated objectives and purposes of the present invention, as it would eliminate the need for the annular support ring and accompanying attachment stanchions or arms. Only eight pins would need to be modified and changed to be joined with or into the annular grasping member, such as a circular polymer rail, molded, extruded or machined.

The fourth embodiment, though least preferred, simply the fixed attachment of any of the above three embodiments' hand grip systems as being alternately attached directly to the rotatable gaming board, within the inside diameter of the spacer pins, not on the pins, but this is the lesser preferred structure of choice, though it may still fulfill nearly all of the above objectives of the invention.

It is also an object to also provide a very lightweight structure to the above hand grip system by eliminating possibly 60% or more of the entire metal pins, then the added net weight that the present hand grip system would potentially be the same or even less than the old art wheels, as used, for example, on the Wheel of Fortune Game Show.

The hand grip systems of all embodiments above may include additional electronic or electrical lighting elements within their structures. The lighting may be powered and signaled at will remotely through direct hard wire or radio controlled means. Many various light emitting means may be adapted to the invention, one of the preferred, however, being a light emitting cable or probe inserted into the circular structure of the said annular graspable member, or into any other part or all of the said hand grip systems' embodiments.

The above summary is general and serves as an overview of the invention. Further features and modifications besides those summarized above will be described in the following description. It should be obvious to one skilled in the present art to se possible general or specific modifications that may be substituted for those employed to achieve the purposes of the present invention, while not departing form the scope or spirit of the present invention.

BRIEF DESCRIPTION OF THE DRAWINGS

FIG. 13 depicts the light emitting element of FIG. 8glowing FIG. 14 is a sectional view of FIG. 13

FIG. 19 is a top view of a modified game board of FIG. 3

FIG. 20 is a side perspective view of FIG. 19

DETAILED DESCRIPTION OF THE PREFERRED EMBODIMENT

Figure 1:
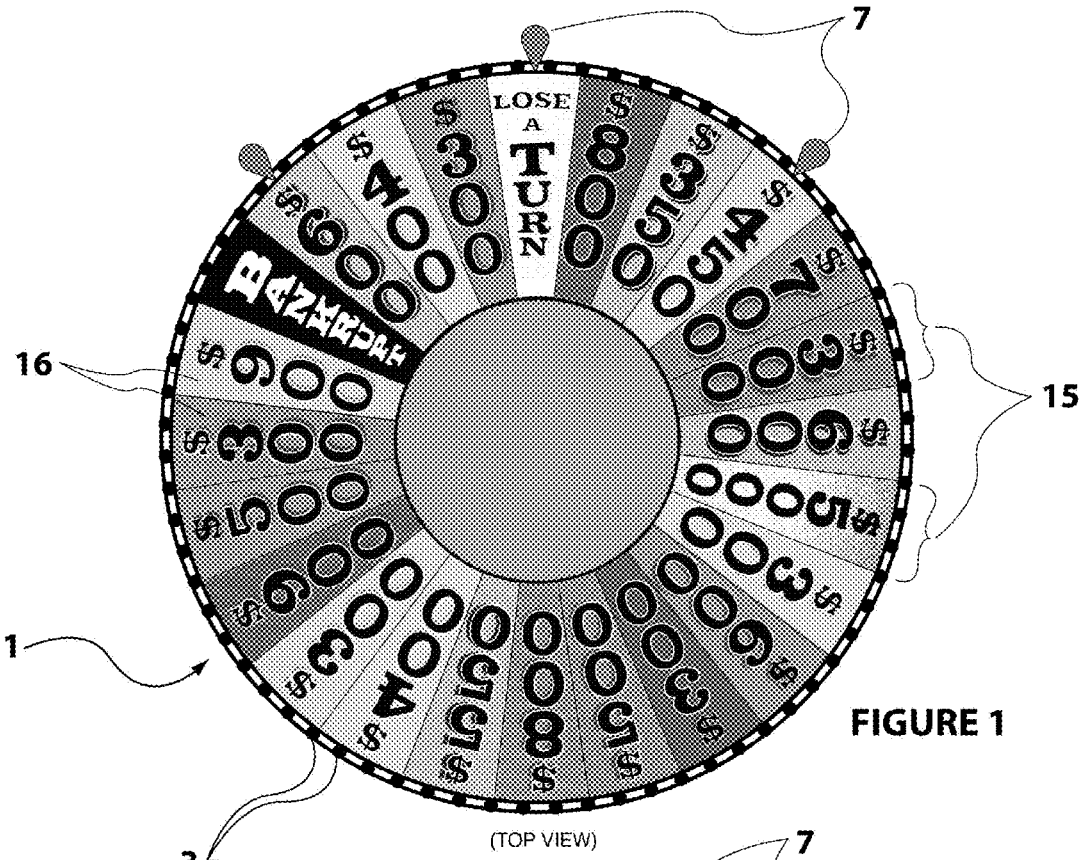
FIG. 1 is top view of the prior art gaming wheel as used in Wheel of Fortune TV Game Show

In describing the preferred embodiments illustrated in the drawings and summarized above, specific terminology shall be resorted to for sake of clarity. However, it is not intended to be limited to the specific terms so selected and it is to be understood that each specific term includes all technical equivalents which operate in a similar manner to accomplish a similar purpose.

Figure 2:
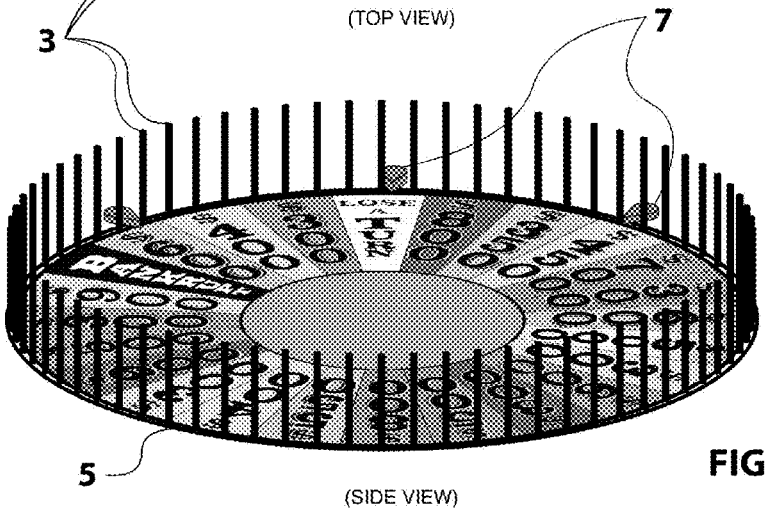
FIG. 2 is a perspective side view of FIG. 1
Figure 3:
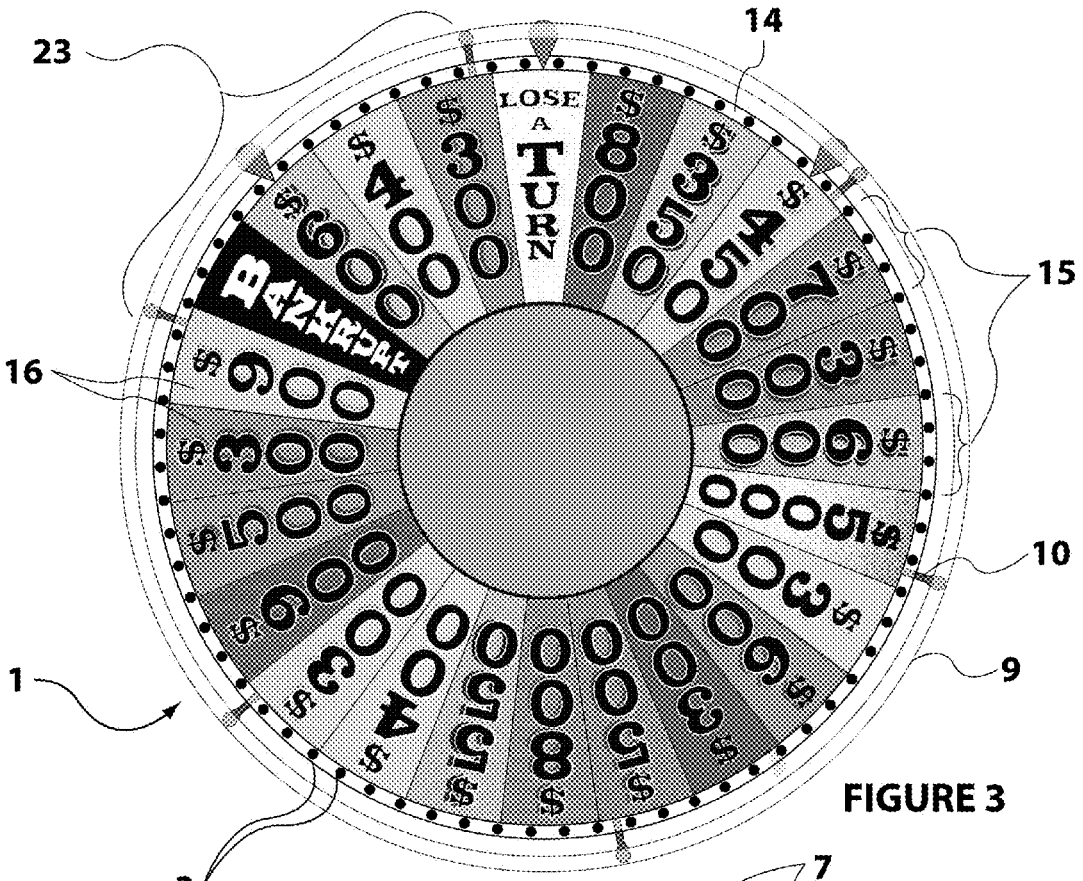
FIG. 3 is top view of the first new art hand grip system of the present invention
Figure 4:
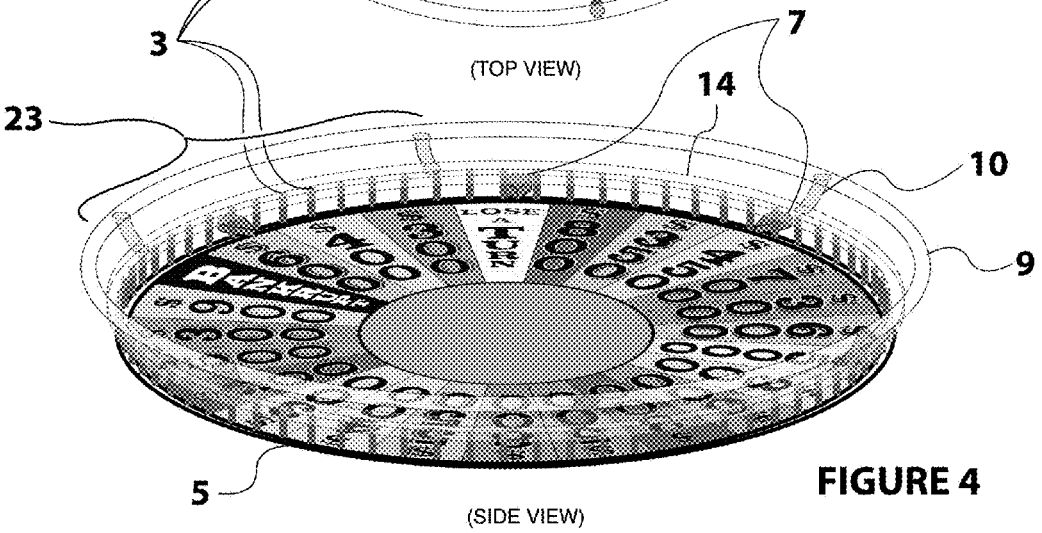
FIG. 4 is side view of FIG. 3
Figure 5:
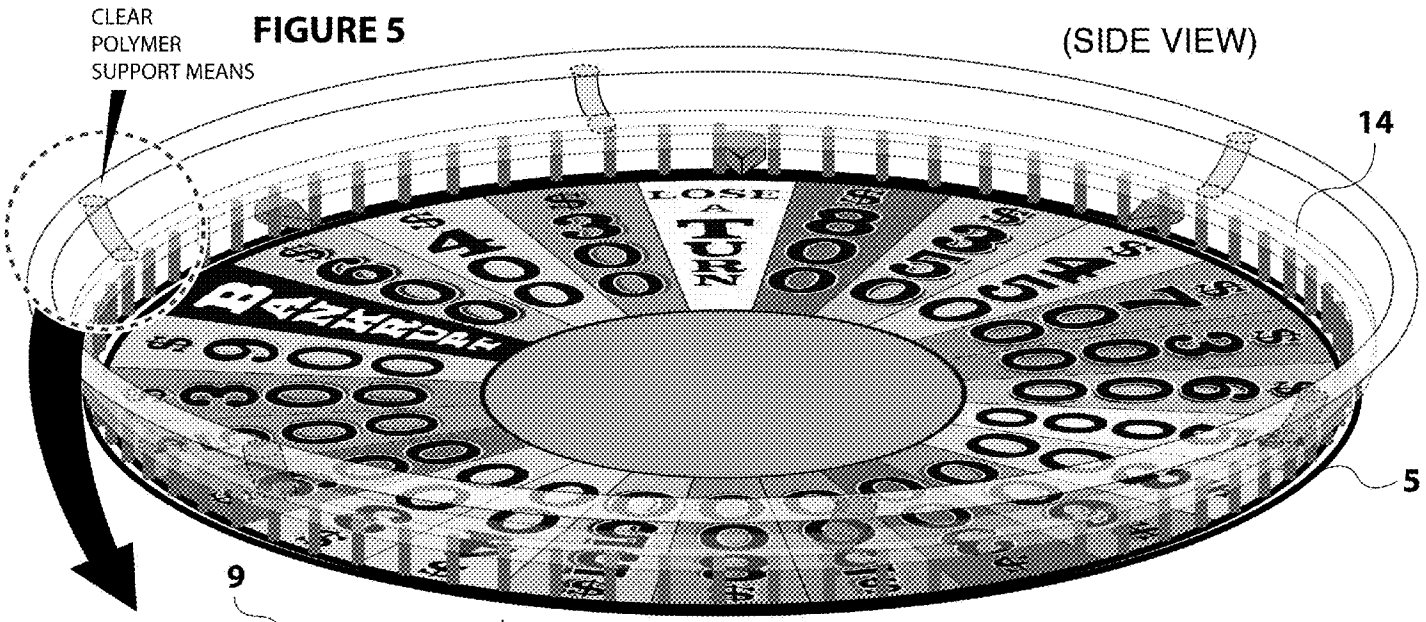
FIG. 5 is an enlarged perspective side view of FIG. 3
Figure 6:
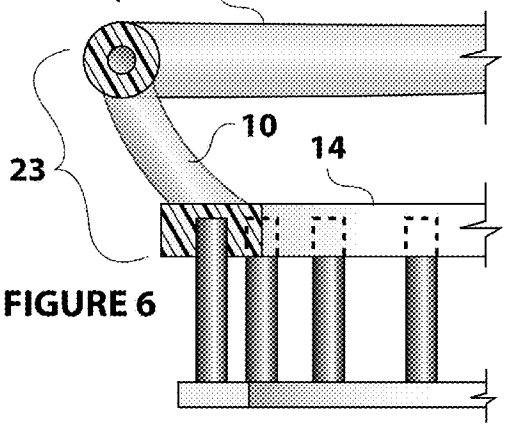
FIG. 6 is a sectional view of the annular graspable member of FIG. 5
Figure 7:
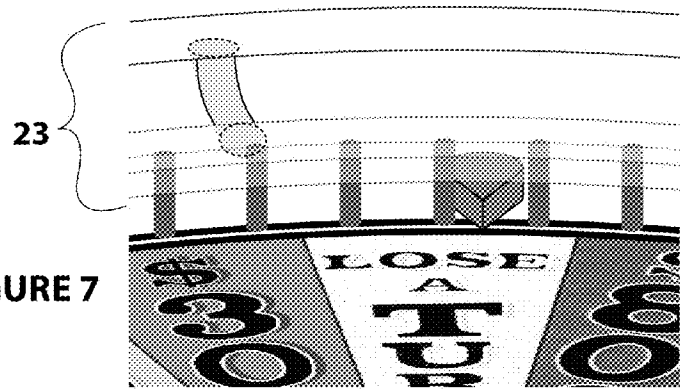
FIG. 7 is perspective sectional view of the annular graspable member of FIG. 5
Figure 8:
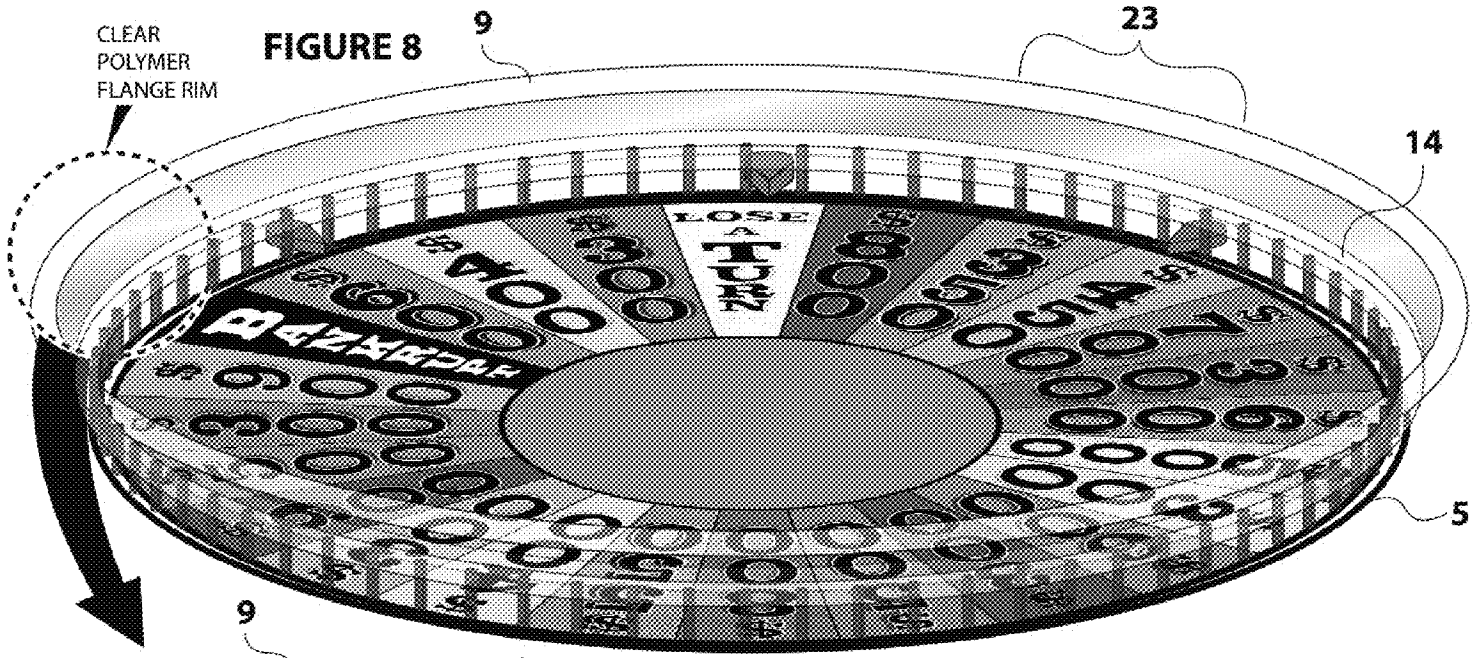
FIG. 8 is an enlarged side perspective view of the second new art hand grip system of the present invention
Figure 9:
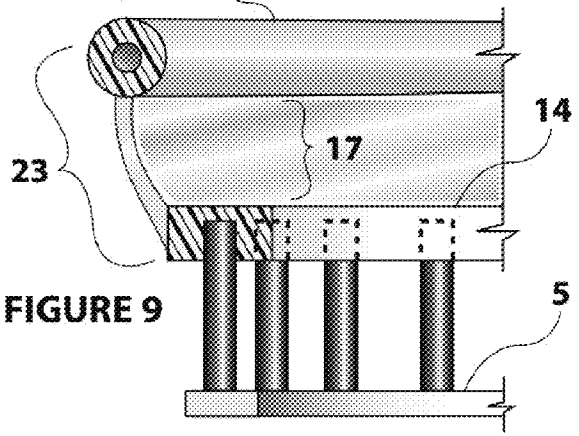
FIG. 9 is a sectional view of FIG. 8 showing the clear polymer flange rim
Figure 10:
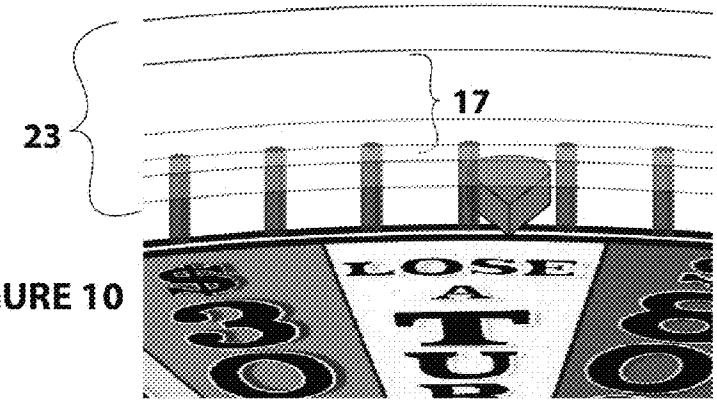
FIG. 10 is perspective sectional view of FIG. 8 showing the clear polymer flange rim
Figure 11:
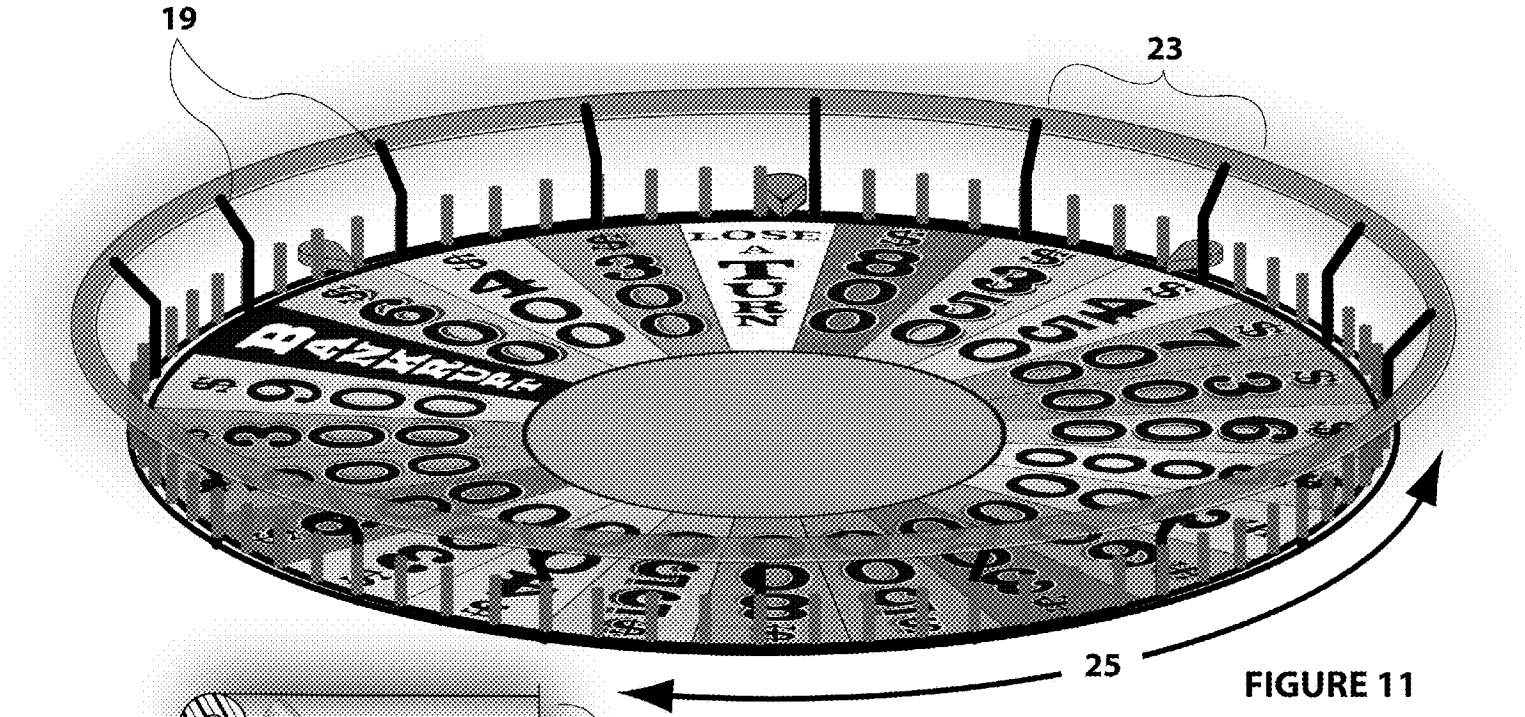
FIG. 11 is an enlarged side perspective view of the third new art hand grip system of the present invention
Figure 12:
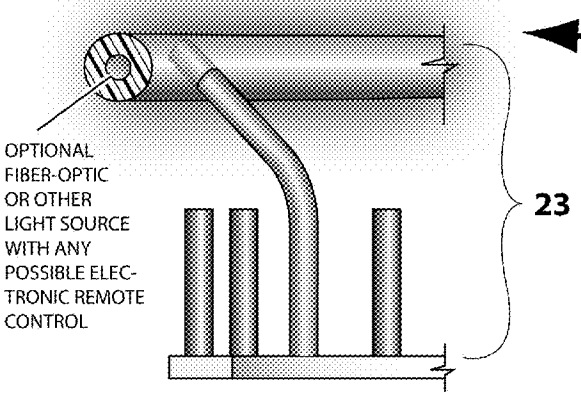
FIG. 12 is sectional view of FIG. 11 illustrating a light emitting means in an annular graspable member
Figure 15:
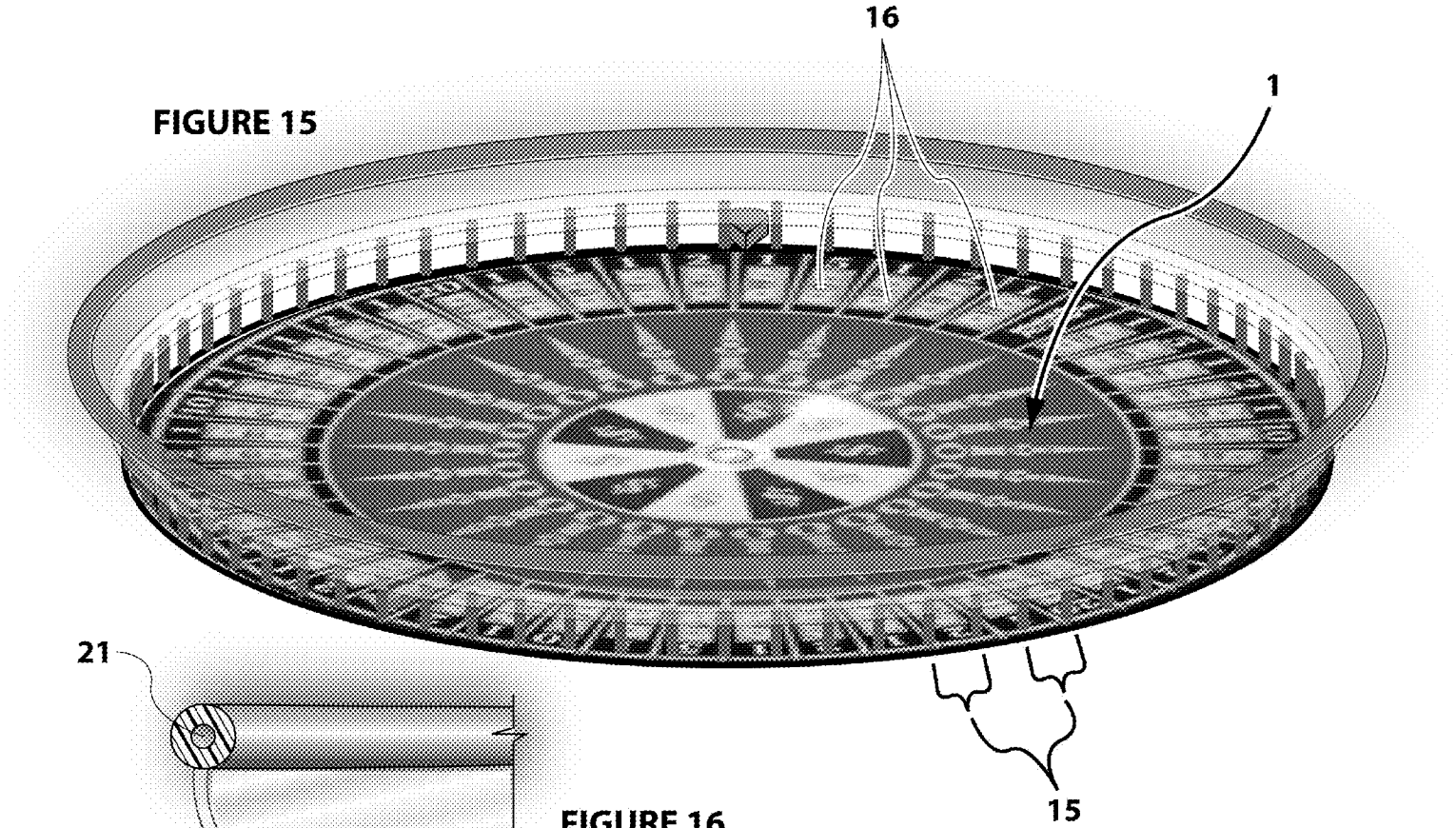
FIG. 15 is an enlarged side perspective view of the second new art hand grip system of the present invention with an alternate game board and light means emanating from the annular graspable member
Figure 16:
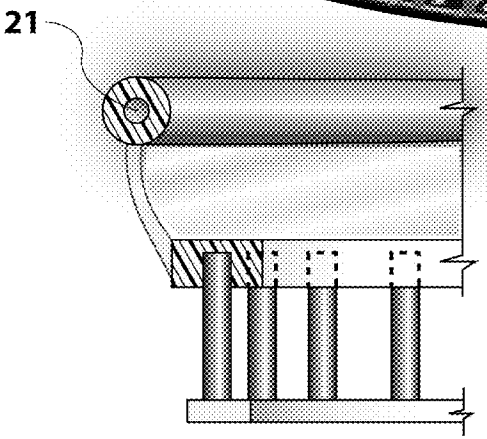
FIG. 16 is a sectional view of FIG. 15
Figure 17:
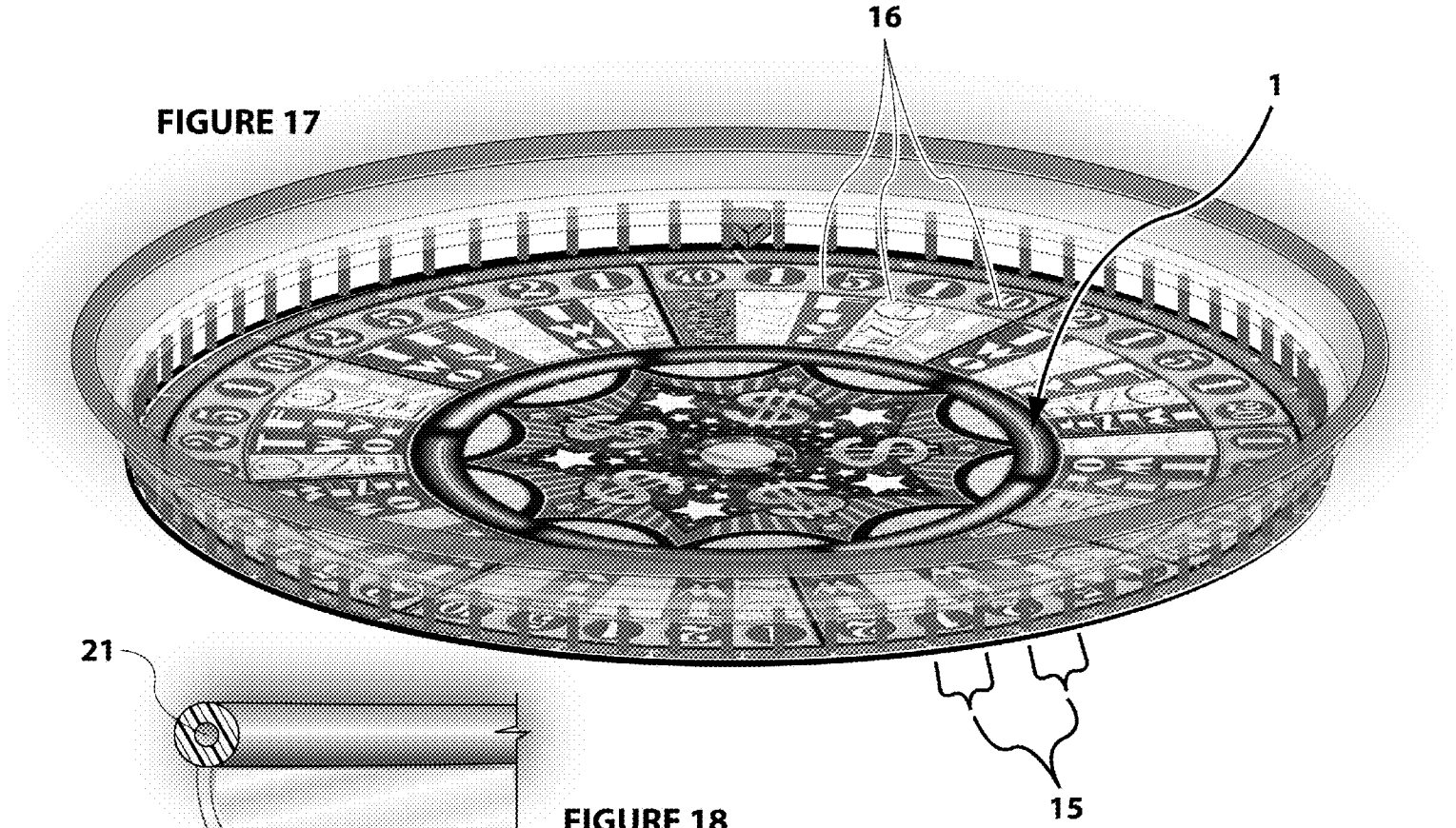
FIG. 17 is an enlarged side perspective view of the second new art hand grip system of the present invention with an another alternate game board and light means emanating from the annular graspable member
Figure 18:
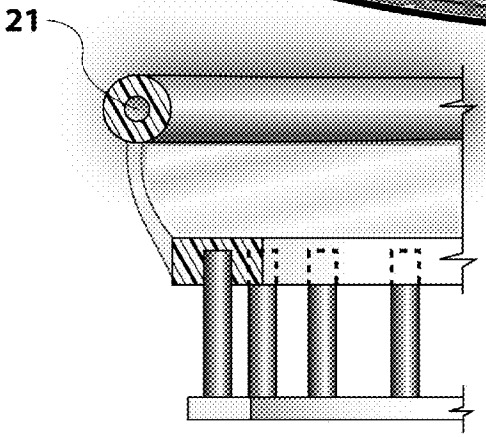
FIG. 18 is a sectional view FIG. 17
Figure 21:
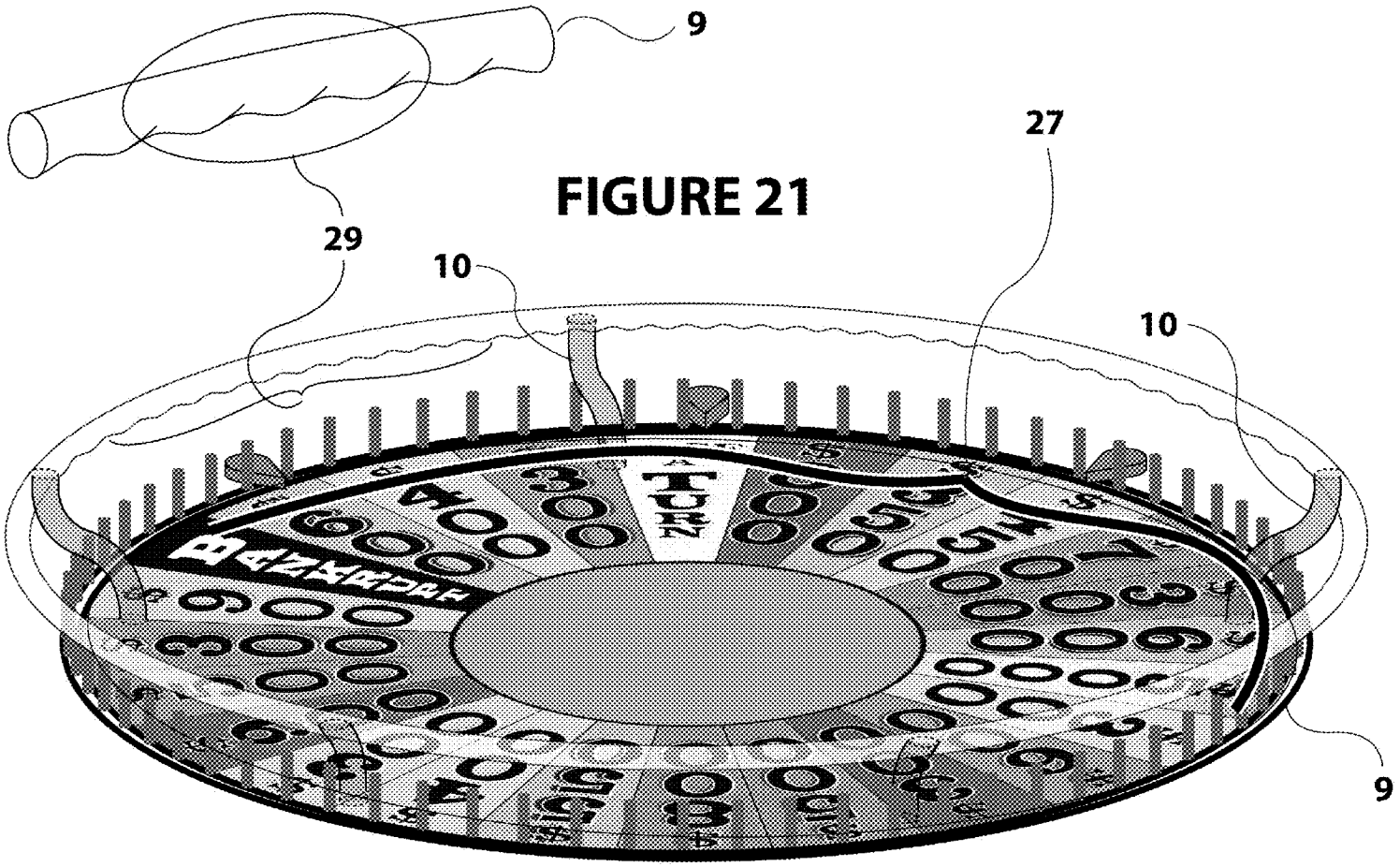
FIG. 21 is a side perspective view of a modified game board having the hand grip system of FIG. 5 affixed directly to the board and not the annularly arrayed stop position means, or pins.

With reference to the prior art to the present invention, referring to FIGS. 1 to FIG. 21, particularly to FIG. 1 and FIG. 2, note gaming wheel 1 comprising a plurality of sectors 15 having informational fields 16, such fields identifying to the wheel user instruction, or in this case the money amount to be received, usually upon meeting the game conditions and criteria. Note FIG. 15 and FIG. 17, wherein said fields 16 can comprise any number of different type and styled content said gaming wheels 1 wherein said fields 16 and instructional information for a wheel user, and as well, in FIG. 19 and FIG. 20, wherein even upright cards may be slotted into place in such said fields 16.

Annularly arrayed stop position means 3 are typically used in the art category of this invention and can be comprised of simple pins, whereby as the wheel user spins the said rotatable gaming wheel 1 said fields 16 are identified when sector identification members 7, which can also be know as spring-clicking flipper indicators, pass over the said pins 3 and eventually stop, as the said wheel's 1 momentum slows to a halt. Games such as Wheel of Fortune® may use typically three of the said sector identification members 7, one for each of three contestants that typically play the game at a time. Most of these types of said gaming wheels have a game board base 5 into which said pins maybe fixed, providing rigidity to the entire wheel apparatus' structure.

Noting FIG. 3 through FIG. 21, the first new art of the present hand grip system is introduced in FIGS. 3 & 4, and FIGS. 5, 6, & 7, wherein The first embodiment includes a hand grip system 23 as having a preferably clear polymer annular support-ring 14 that is affixed annularly to the top of the "old art" said annularly arrayed stop position means 3, aka., pins 3 of the former art. These pins would remain in the same general location, connected to the said game board base 5, as in the old art, in a similar annularly arrayed position, but would be shorter in length, yet so that the said flipper indicator's (aka., sector identification member) 7 thickness could easily pass under this said support ring 14, even as the said gaming wheel 1 was spun. Jutting outward, inward or upward from the said support ring are annular graspable member stanchions, aka., annular graspable member support means 10 that both connect and support an annular graspable member 9, what also may be known as a circular rail. The user simply grasps this said annular graspable member 9 with their hand and manually thrusts it in one direction, rather than grasping the old art pins 3, and risking injury to their hands, at the very least. It is to be noted that in assembly the said pins 3 would not have to be fixedly sealed into the said annular support ring 14 or the said annular grasping member 9, but cold be "slip fit" so that easy assembly and disassembly of the entire said gaming board apparatus 1 could occur.

The second embodiment includes a said hand grip system 23 as having preferably a clear polymer annular support ring 14 that is affixed annularly to the top of the "old art" said pins 3 of the former art. These said pins 3 would remain in the same general location, connected to the said game board base 5, as in the old art, in a similar annularly arrayed position, but would be shorter in length, yet so that the said flipper indicator's 7 thickness could easily pass under this said support ring 14, even as the said gaming wheel 1 was spun. Jutting outward, inward or upward from the said support ring 14 is an annular flange rim 17 integrally joined, preferably molded or formed as one piece, to the said annular graspable member 9, or what also may be known as a circular rail. The user simply grasps this said annular graspable member 9 with their hand and manually thrusts it in one direction, rather than grasping the old art said pins 3, and risking injury to their hands, at the very least. This second embodiment is considered to be more foolproof and safer than the first or third embodiments, since there are no connecting members the user cannot get their fingers or hand caught on anything, as on a said pin 3 or on an upwardly jutting said support arm 10, aka., annular graspable member support means 10. It is to be noted that in assembly the said pins 3 would not have to be fixedly sealed into the support ring or the said annular grasping member 9, but could be "slip fit" so that easy assembly and disassembly could occur.

The third embodiment includes a said hand grip system 23 as having preferably a clear polymer said annular graspable member 9, or what may be known as a circular rail that is affixed annularly to the top of at a few of the "old art" said pins 3 of the former art. Most of these said pins 3 would remain in the same general location, connected to the same said board base 5, as in the old art, in a similar annularly arrayed position, but would be shorter in length, yet so that the said flipper indicator's 7 thickness could easily pass under the said annular graspable member 9, even as the game wheel was spun. However, several of the said pins 3, at least three, but preferably at least eight would be longer than the other remaining annularly arrayed pins. These few key support pins 19 would be jutting outward, inward or upward from the said board in the same annular array of shorter said pins 3, and these several said key support pins 19, preferably equally spaced around the game board circumference 25, would attach at their upper, opposite ends (opposite the game board side) into the said annular graspable member 9, or what also may be known as a circular rail. The user simply grasps this said annular graspable member 9 with their hand and manually thrusts it in one direction, rather than grasping the said old art pins 3, and risking injury to their hands, at the very least. This third embodiment may be understood as the easiest embodiment to manufacture and employ for the stated objectives and purposes of the present invention, as it would eliminate the need for the said annular support ring 14 and accompanying attachment stanchions or said arms 10. Only eight said key support pins 19 would need to be modified and changed to be joined with or into the said annular grasping member 9, such as a circular polymer rail, molded, extruded or machined.

The fourth embodiment, though least preferred, simply the fixed attachment of any of the above three embodiments' said hand grip systems 23 as being alternately attached directly to the said rotatable gaming board 1, within the inside board diameter 27 of the said spacer pins 3, but not on the said pins 3. This is a lesser preferred structure, though still fulfilling nearly all of the invention's objectives. Note gripping contours 29 which enable tighter grip upon said grasping member 9.

The entire said hand grip system 23 maybe made of a very lightweight structure as possibly up to 60% or more of the entire metal said pins 3 length may be reduced, then the added net weight that the present hand grip system would potentially be the same or even less than the old art wheels, as used, for example, on the Wheel of Fortune Game Show.

The said hand grip systems 23 of all embodiments above may include additional electronic or electrical lighting elements within their structures, shown in FIGS. 6 & 9, and FIG. 11 through FIG. 18 as a light emitting means 21 which may be powered and signaled at will remotely through direct hard wire or radio controlled means. Many various said light emitting means 21 may be adapted to the invention, one of the preferred, however, being a light emitting cable or probe inserted into the circular structure of the said annular graspable member, or into any other part or all of the said hand grip systems' 23 embodiments. Of course such light emitting means can be included in any of the other structure parts of the said Hand grip system 1, such as the said annular support ring 14, as well.

It is to be understood that the form of the invention herewith shown and described above is to be taken as preferred embodiments. Various changes may be made in the shape, size and arrangement of parts, for example: other equivalent elements may be substituted for those illustrated and described herein, parts and elements may be reversed, and certain features of the invention maybe utilized independently of the use of other features, all without departing form the spirit or scope of the invention, as defined in the subjoining claims.

What is claimed is:

1. A hand grip system for safely, manually grasping and spinning gaming wheels comprising:

a rotatable gaming wheel having a plurality of annularly arrayed stop position means affixed near an outer board diameter of said gaming wheel; said gaming wheel further comprising a game board base whereupon are sectors which are randomly chosen as a user spins said gaming wheel;

at least one sector identification member, whereby at least one said sector may be randomly selected as a gaming wheel user manually spins said gaming wheel, wherein said at least one sector identification member pivots about an axis that is both parallel to and radially displaced from an axis of rotation of said rotatable gaming wheel;

an annular graspable member carried by said rotatable gaming wheel so as not to inhibit function of said sector identification member as said rotatable gaming wheel is spun, wherein said sector identification member has a portion that is located radially beyond the outer board diameter of said rotatable gaming wheel, wherein the at least one sector identification member is located at a height in a longitudinal direction of the axis of rotation of said rotatable gaming wheel that is not as high as the annular graspable member but higher than the game board base; and a support member that is joined to said annularly arrayed stop position means and said annular graspable member so as to not inhibit function of said sector identification member as said rotatable gaming wheel is spun.

2. The invention as recited in claim #1 wherein the said annularly arrayed stop position means has pins annularly arrayed around a perimeter of the said rotatable gaming wheel and wherein the said pins are joined to an annular support ring; wherein said annular graspable member further being rigidly connected to said annular support ring by also being rigidly connected to said graspable member support member; and wherein the at least one sector identification member is a flipper-indicator having a flipper that is spring biased upon the said annularly arrayed pins.

3. The invention as recited in claim #1 wherein the said annularly arrayed stop position means has pins annularly arrayed around a perimeter of the said rotatable gaming wheel and wherein the said pins are joined to an annular support ring, and wherein said support member is a flange rim; said annular graspable member being joined to said flange rim; and wherein the at least one sector identification member is a flipper-indicator having a flipper that is spring biased upon the said annularly arrayed pins.

4. The invention as recited in claim #1 wherein the said annularly arrayed stop position means are pins annularly arrayed around a perimeter of the said rotatable gaming wheel and wherein at least three said pins are further defined as key support pins that each have a portion that are part of the support member which are joined to the said annular graspable member; and wherein the at least one sector identification member is a flipper-indicator having a flipper that is spring biased upon the said annularly arrayed pins.

5. The invention as recited in claim #1 wherein the said support member is directly, rigidly attached to said annularly arrayed stop position means.

6. The invention as recited in claim #5 wherein the said annular graspable member is directly, rigidly attached to said game board base furthermore, both within the said outer board diameter and inside the said annularly arrayed stop position means in a radial direction of said gaming wheel such that an attachment point of said annular graspable member to said game board base is located radially closer to a center of said gaming wheel than said annularly arrayed stop position means.

7. The invention as recited in claim #1 wherein the said annular graspable member is directly, rigidly attached to said game board base by an annular graspable member support means that has a curved shape.

8. The invention as recited in claim #1 further comprising light emitting means within the annular grasping member.

9. The invention as recited in claim #8 wherein the said light emitting means within the annular grasping member is powered by hard wire but remotely controlled.

10. The invention as recited in claim #8 wherein the said light emitting means within the annular grasping member is hard wire powered controlled.

11. The invention as recited in claim #1 further comprising an annular support ring and further comprising light emitting means within the annular support ring.

12. The invention as recited in claim #1 wherein the said hand grip system is constructed of a lightweight, transparent polymer.

13. The invention as recited in claim #1 wherein the said annular graspable member includes gripping contours.

14. The invention as recited in claim #1 wherein the said rotatable gaming wheel rotates on an axis where said rotating axis is substantially horizontal to the ground.

15. The invention as recited in claim #1 wherein the said rotatable gaming wheel rotates on an axis where said rotating axis is substantially perpendicular to the ground.

16. A hand grip system for safely, manually grasping and spinning gaming wheels comprising:

a rotatable gaming wheel having a plurality of annularly arrayed stop position means affixed near an outer board diameter of said gaming wheel; said gaming wheel further comprising a game board base whereupon are sectors which are randomly chosen as a user spins said gaming wheel;

at least one sector identification member, whereby at least one said sector may be randomly selected as a gaming wheel user manually spins said gaming wheel, wherein said at least one sector identification member pivots about an axis that is both parallel to and radially displaced from an axis of rotation of said rotatable gaming wheel;

wherein the said annularly arrayed stop position means has pins annularly arrayed around a perimeter of the said rotatable game board base;

and wherein the at least one sector identification member has at least one flipper-indicator;

an annular graspable member supported by and engaged by at least one of said pins of said annularly arrayed stop position means so as not to inhibit function of said sector identification member as said rotatable gaming wheel is spun, wherein a portion of said sector identification member is radially beyond said at least one of said pins, wherein the at least one sector identification member is located at a height in a longitudinal direction of the axis of rotation of said rotatable gaming wheel that is not as high as the annular graspable member but higher than the game board base.

17. The invention as recited in claim #16 wherein the said hand grip system is constructed of a lightweight, transparent polymer.

18. A hand grip system for safely, manually grasping and spinning gaming wheels comprising:

a rotatable gaming wheel having a plurality of annularly arrayed stop position means affixed near an outer board diameter of said gaming wheel; said gaming wheel further comprising a game board base whereupon are sectors which are randomly chosen as a user spins said gaming wheel;

at least one sector identification member, whereby at least one said sector may be randomly selected as a gaming wheel user manually spins said gaming wheel, wherein said at least one sector identification member pivots about an axis that is both parallel to and radially displaced from an axis of rotation of said rotatable gaming wheel;

an annular graspable member that does not inhibit function of said sector identification member as said rotatable gaming wheel is spun; and wherein the said annularly arrayed stop position means has pins annularly arrayed around a perimeter of the said rotatable game board base, wherein said annular graspable member is supported by a support means a portion of which is located radially closer to an axial center of said game board base than one of said pins and is located above and radially closer to the axial center of said game board base than an outer radial edge of one of said sectors, wherein the at least one sector identification member is located at a height in a longitudinal direction of the axis of rotation of said rotatable gaming wheel that is not as high as the annular graspable member but higher than the game board base.

19. The invention as recited in claim #18 wherein the said hand grip system is constructed of a lightweight, transparent polymer.

20. The invention as recited in claim #18 wherein the at least one sector identification member are three flipper-indicators further comprised of three flippers that are spring biased upon the said pins, wherein said support means are arms curved in shape such that they extend upwards from said game board base in a direction radially outward from a center of said game board base.

* * * * *